US008147084B2

(12) United States Patent
Lin

(10) Patent No.: US 8,147,084 B2
(45) Date of Patent: Apr. 3, 2012

(54) EAR HOOK DEVICE WITH ILLUMINATION FUNCTION

(75) Inventor: Chong-Jiang Lin, Taichung County (TW)

(73) Assignee: Sunny Wheel Industrial Co., Ltd., Changhua County (TW)

( * ) Notice: Subject to any disclaimer, the term of this patent is extended or adjusted under 35 U.S.C. 154(b) by 326 days.

(21) Appl. No.: 12/501,438

(22) Filed: Jul. 12, 2009

(65) Prior Publication Data

US 2011/0007495 A1 Jan. 13, 2011

(51) Int. Cl.
*F21V 21/084* (2006.01)
*A44B 6/00* (2006.01)

(52) U.S. Cl. ..... 362/105; 362/103; 362/104; 362/191; 362/427; 362/202; 362/396; 24/3.12; 24/8

(58) Field of Classification Search ..... 362/103, 362/104, 105, 191, 427, 202, 396; 24/3.12, 24/8

See application file for complete search history.

(56) References Cited

U.S. PATENT DOCUMENTS

| | | | | |
|---|---|---|---|---|
| 3,249,271 | A * | 5/1966 | Allbritton | 224/181 |
| 4,969,069 | A * | 11/1990 | Eichost | 362/105 |
| 5,412,545 | A * | 5/1995 | Rising | 362/105 |
| 6,477,744 | B1 * | 11/2002 | Miles | 24/3.12 |
| 7,097,321 | B2 * | 8/2006 | Mehler et al. | 362/190 |
| 7,258,582 | B2 * | 8/2007 | Maglica | 439/700 |
| 7,546,753 | B1 * | 6/2009 | Kim | 70/456 R |

* cited by examiner

*Primary Examiner* — Jong-Suk (James) Lee
*Assistant Examiner* — Tsion Tumebo

(57) ABSTRACT

An ear hook device with illumination function is worn on a user's ear to provide illumination, so that the user can have their hands free to do more works. Furthermore, the ear hook device is further provided with a holding assembly which can hold the ear hook device and is then clipped to the user's pocket when the ear hook device is not in use, making it easier for the user to use and carry the ear hook device.

11 Claims, 8 Drawing Sheets

EAR HOOK DEVICE WITH ILLUMINATION FUNCTION

BACKGROUND OF THE INVENTION

1. Field of the Invention

The present invention relates to an ear hook device, and more particularly an ear hook device with illumination function.

2. Description of the Prior Art

Nowadays, people are mostly busy and want to complete a work in the shortest possible time, hence, an ear hook device which possesses communication function and information sending/receiving function by being equipped with earphone, Bluetooth or microphone was invented, so that the user can free their hands to do other stuffs. However, most of the existing ear hook devices are limited in functions, for example, the "ear-hook type illumination device" disclosed in Taiwan Pub No. M299907 and the "ear hook device with illumination function" disclosed in Taiwan Pub No. I285718 only have an illumination function, so they can only be used as an illumination device.

The present invention has arisen to mitigate and/or obviate the afore-described disadvantages.

SUMMARY OF THE INVENTION

The primary object of the present invention is to provide an ear hook device with illumination function, wherein the ear hook device is worn on the ear of a user to provide illumination, and the ear hook device is easy to assemble and use and can also be used for storage of stuffs.

To achieve the above object, an ear hook device with illumination function in accordance with the present invention comprises: a hook to be worn on the ear of a user, a locking device, and a carrying unit. The locking device includes a retaining member and a mounting member, the retaining member is defined with a clamping portion with a notch, the clamping portion of the retaining member is clamped on the hook, and the mounting member is connected to one side of the retaining member. The carrying unit is locked in the mounting member of the locking device.

Another object of the present invention is to provide an easily portable ear hook device with illumination function, wherein the ear hook device is further provided with a holding assembly which includes a holding frame and a seat. The holding frame includes at least one inserting end which is connected to a holding portion and inserted through the clamping portion of the locking device and into the seat, and the seat is provided with a hook portion for engaging with the hook. With the holding assembly, the ear hook device of the present invention can also be used as key ring to carry keys.

DETAILED DESCRIPTION OF THE PREFERRED EMBODIMENTS

Figure 1:
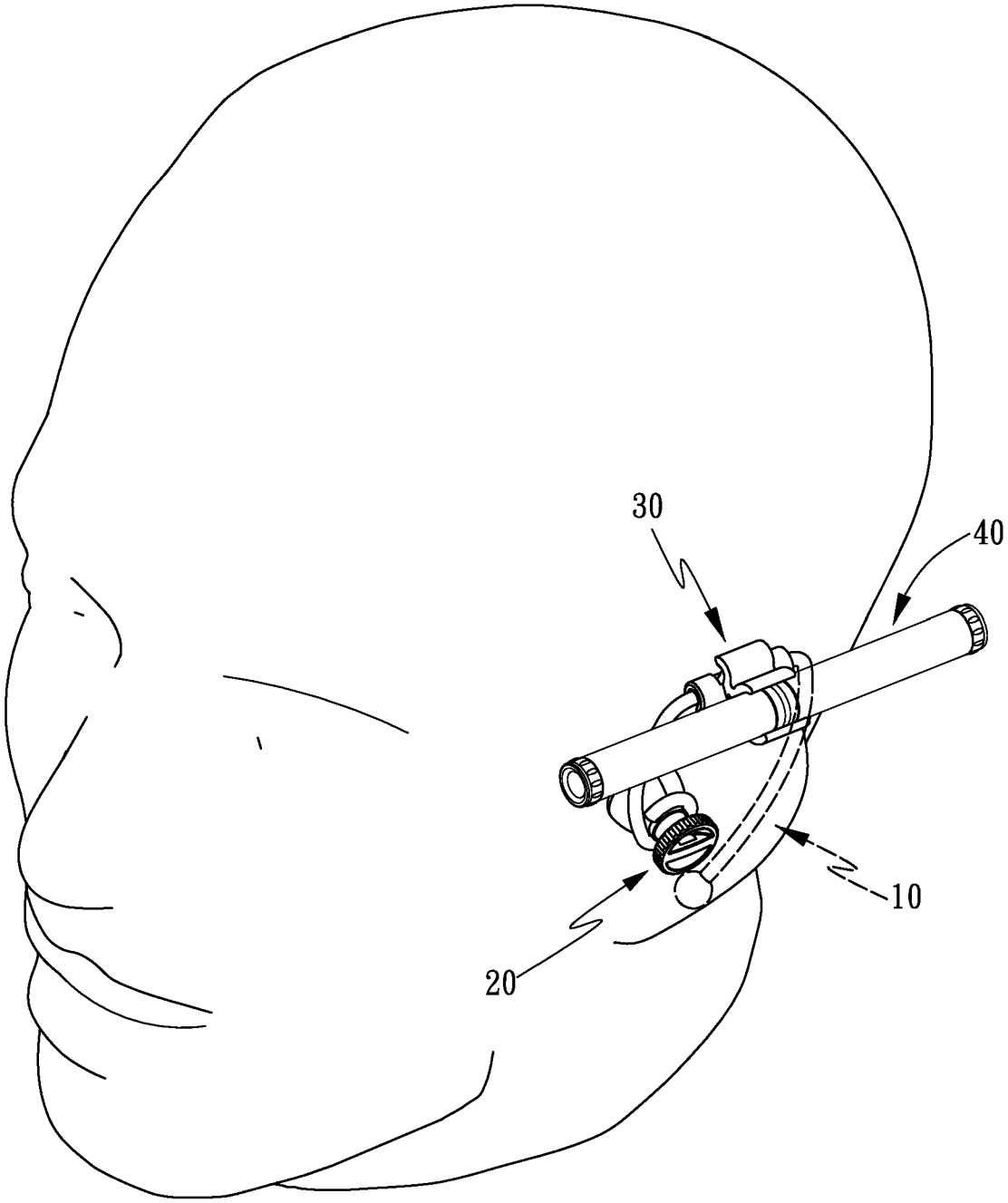
FIG. 1 shows that an ear hook device with illumination function in accordance with the present invention is worn on the ear.
Figure 2:
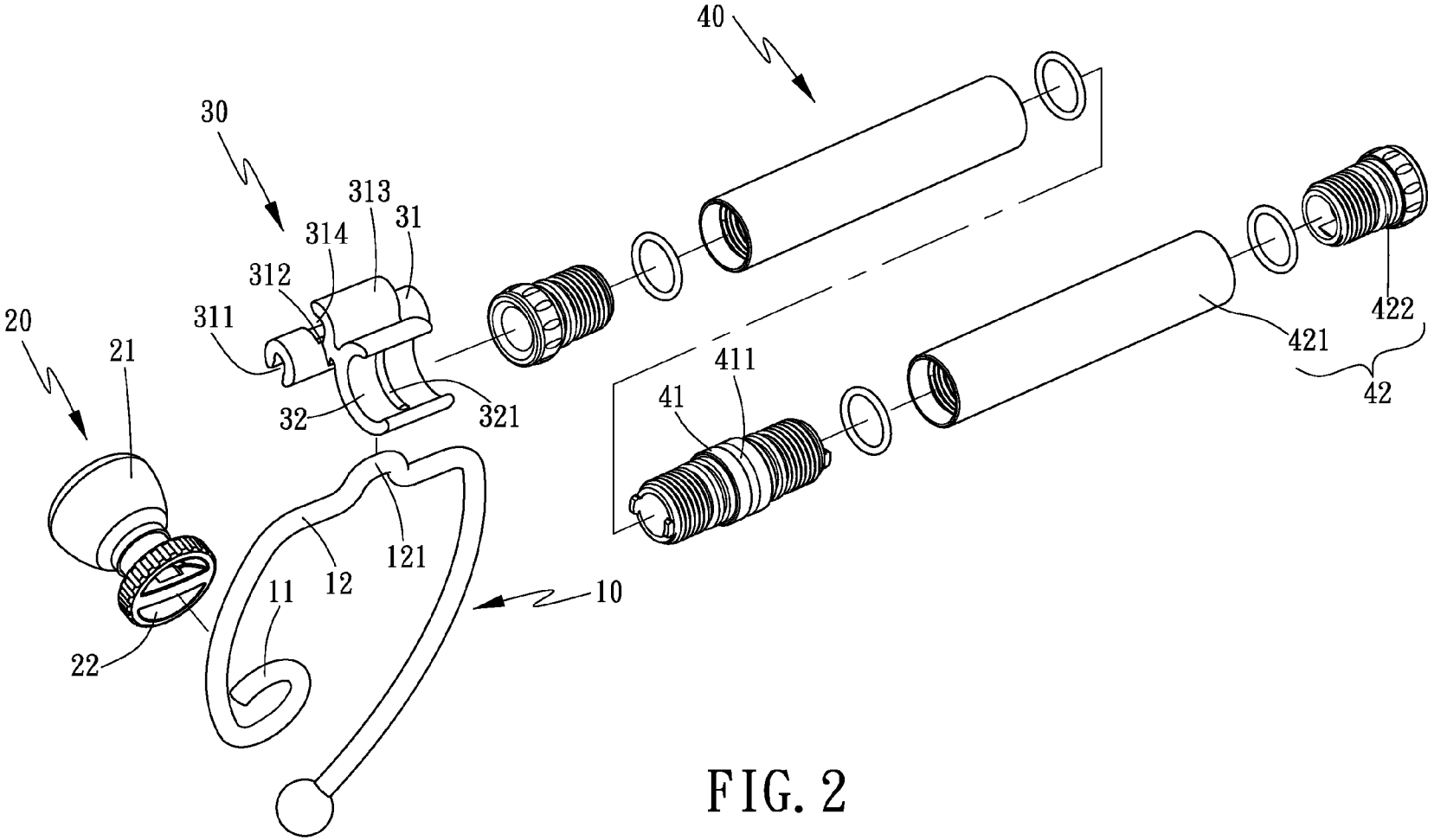
FIG. 2 is an exploded view of the ear hook device with illumination function in accordance with the present invention.
Figure 3:
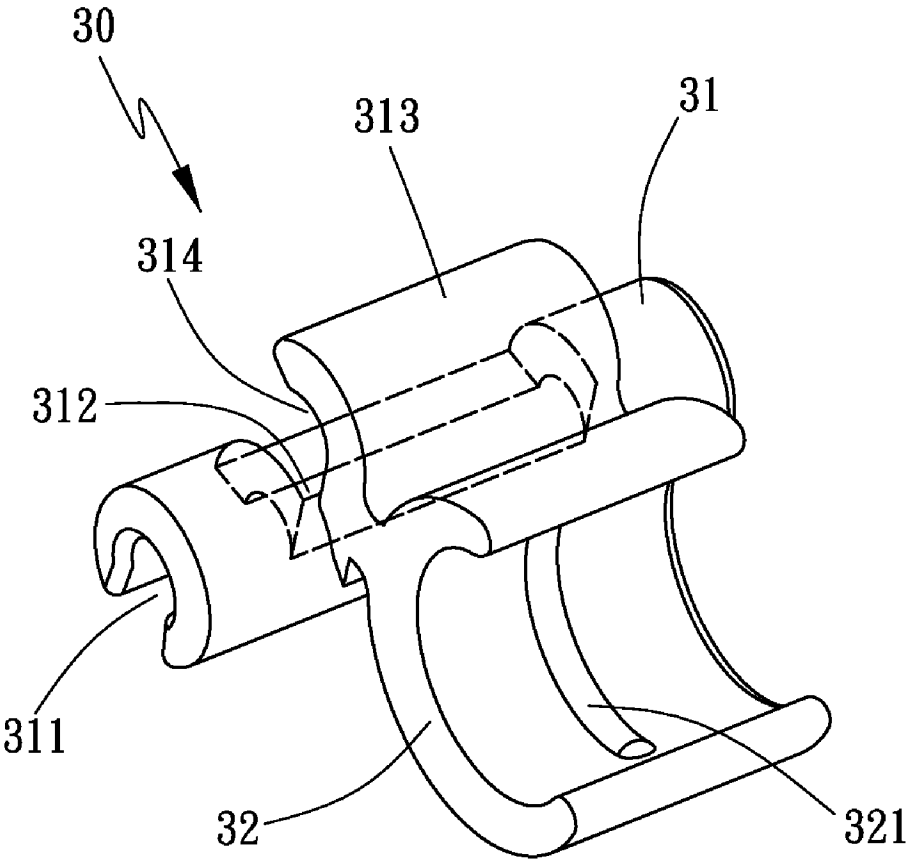
FIG. 3 shows a locking device of the ear hook device with illumination function in accordance with the present invention.
Figure 4:
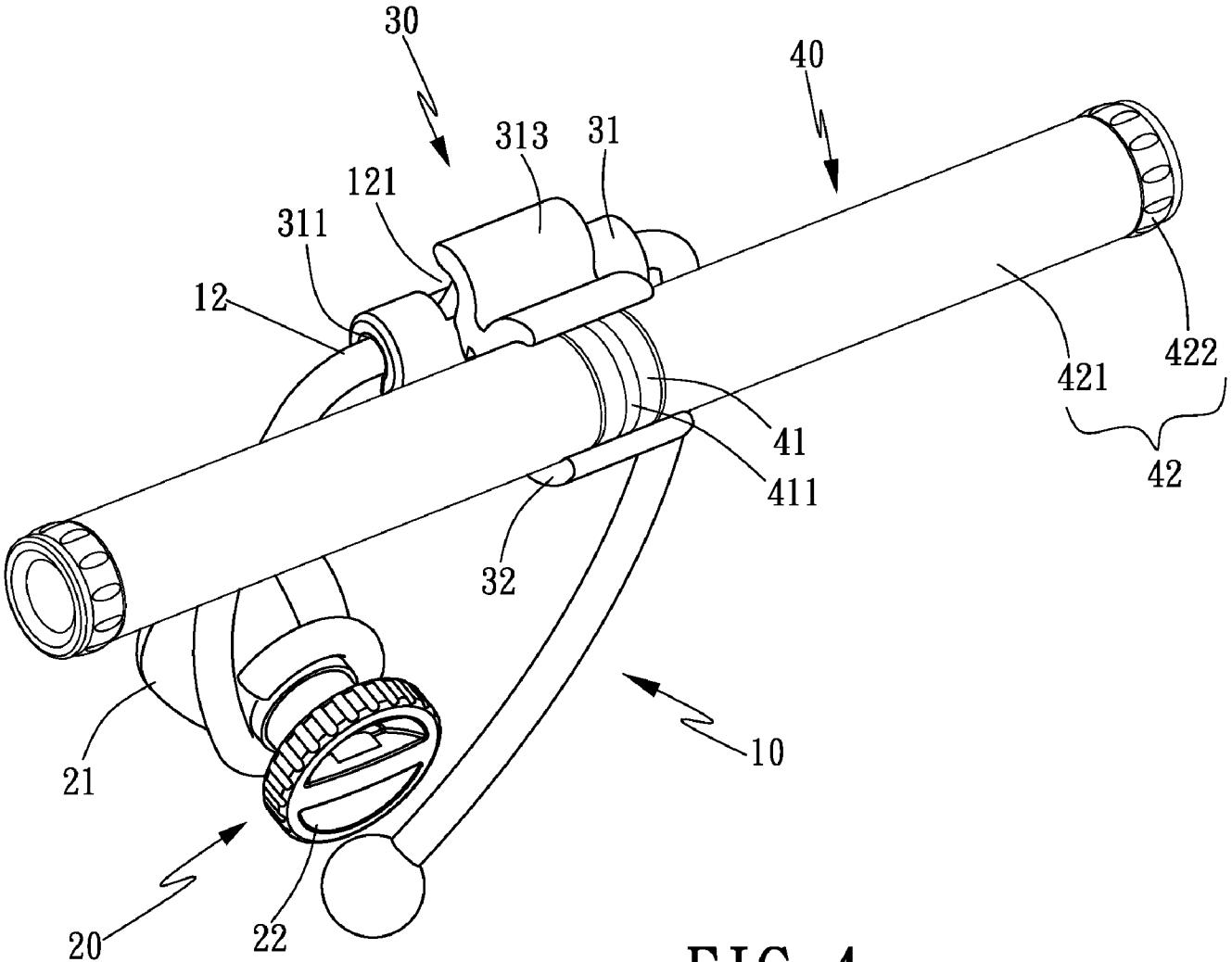
FIG. 4 is an assembly view of the ear hook device with illumination function in accordance with the present invention.
Figure 5:
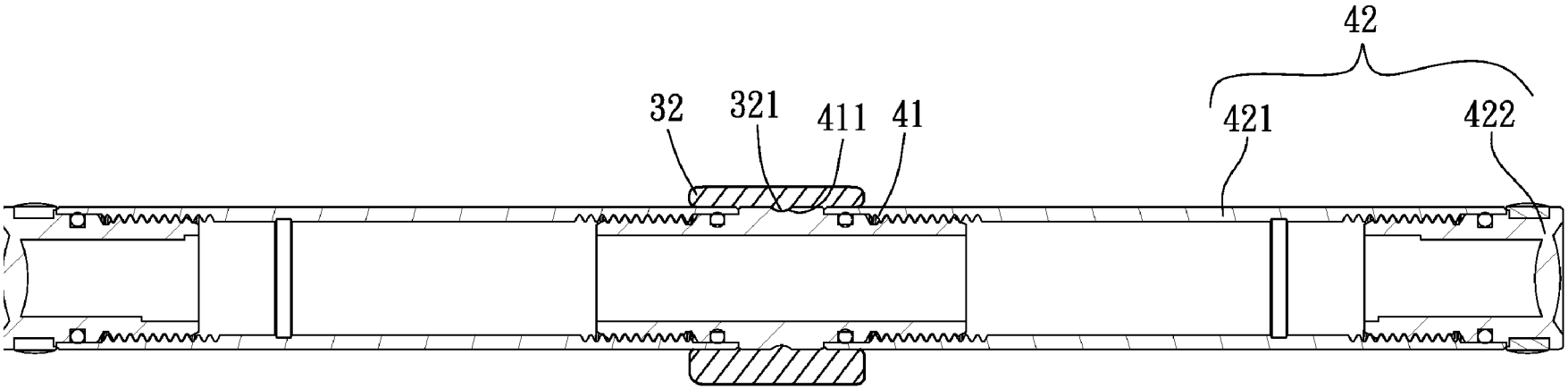
FIG. 5 is a cross sectional view of a carrying unit of the ear hook device with illumination function in accordance with the present invention.

The present invention will be clearer from the following description when viewed together with the accompanying drawings, which show, for purpose of illustrations only, the preferred embodiment in accordance with the present invention.

Referring to FIGS. 1-5, an ear hook device with illumination function in accordance with the present invention comprises: a hook 10, an ear ornament 20, a locking device 30, and a carrying unit 40.

The hook 10 is to be worn on the ear of a user and has one end curved to form a hole 11 and has a middle portion 12 formed between both ends thereof, and the middle portion 12 protrudes upward to form an engaging portion 121.

The ear ornament 20 includes a seat portion 21 and an ornament portion 22. The seat portion 21 has one end inserted in the hole 11 of the hook 10 and the other end to press against the ear of the user. The ornament portion 22 is inserted in the other end of the seat portion 21 and exposed out of the hole 11 of the hook 10.

The locking device 30 includes a retaining member 31 and a mounting member 32. The retaining member 31 is made of a laminate member which is folded to form a clamping portion 311 with a notch, and the retaining member 31 is further provided in a side opposite the notch of the clamping portion 311 with a hole 312. An engaging piece 313 is formed beside the hole 312, and an engaging portion 314 is defined between the hole 312 and the engaging piece 313. The mounting member 32 is connected to one side of the engaging piece 313 and has a C-shaped cross section. On an inner surface of the mounting member 32 is formed a rib 321. The clamping portion 311 of the retaining member 31 is clamped on the middle portion 12 of the hook 10 in such a manner that the engaging portion 121 of the middle portion 12 of the hook 10 is inserted through the engaging portion 314 of the retaining member 31 and engaged in the engaging piece 313.

The carrying unit 40 includes a connecting member 41 and two cylinder assemblies 42. Each of the cylinder assemblies 42 includes a cylinder member 421 and a cover 422. The connecting member 41 is formed in its outer surface with an annular groove 411 for engaging with the rib 321 of the mounting member 32, so that the connecting member 41 is positioned in the mounting member 32. The two cylinder assembly 42 each have one end connected to both ends of the connecting member 41, and then the two covers 422 are mounted to the other end of the respective cylinder members 421 which are provided for storing battery or other stuffs. Light emitting devices (not shown) can be disposed in the covers 422. When the covers 422 are mounted to the cylinder members 421, they will be brought into electrical contact with the batteries therein, so that the light emitting devices are turned on and emit light.

When the carrying unit 40 is locked on the hook 10 by the locking device 30, the user can wear the hook 10 on his ear, and the light emitting devices carried on the carrying unit 40 are used to provide illumination. The ear hook of the present invention can provide different effects when used in different situations. For example, if a user riding a bike at night wears the ear hook device with illumination function, the light emitting devices at the front and rear ends of the ear hook device can light up the darkness in front of and behind the rider, and especially, the rear light emitting device makes the rider more visible, improving riding safety. The ear hook device of the present invention can also be worn by the repairers who repair motorcycle, bike or all kinds of equipments, with the ear hook device providing illumination, the repairers can have their hands free to do the repair work. The ornament portion 22 of the ear ornament 20 can be ornamented with different colors, patterns or logo, so that the ear ornament 20 can be used not only as an ornament but also as an earplug to protect the user from the noise produced during repair work. Furthermore, the covers 422 of the cylinder assemblies 42 of the carrying unit 40 can also contain no light emitting devices, and the cylinder member 421 can be used to store other stuffs, such as, pen, cigarette, or small tools for repairing the bike. In addition, the structural design for jointing the cylinder members 421 to the hook 10 is very easy and simple, which allows for easy use of the present invention.

Figure 6:
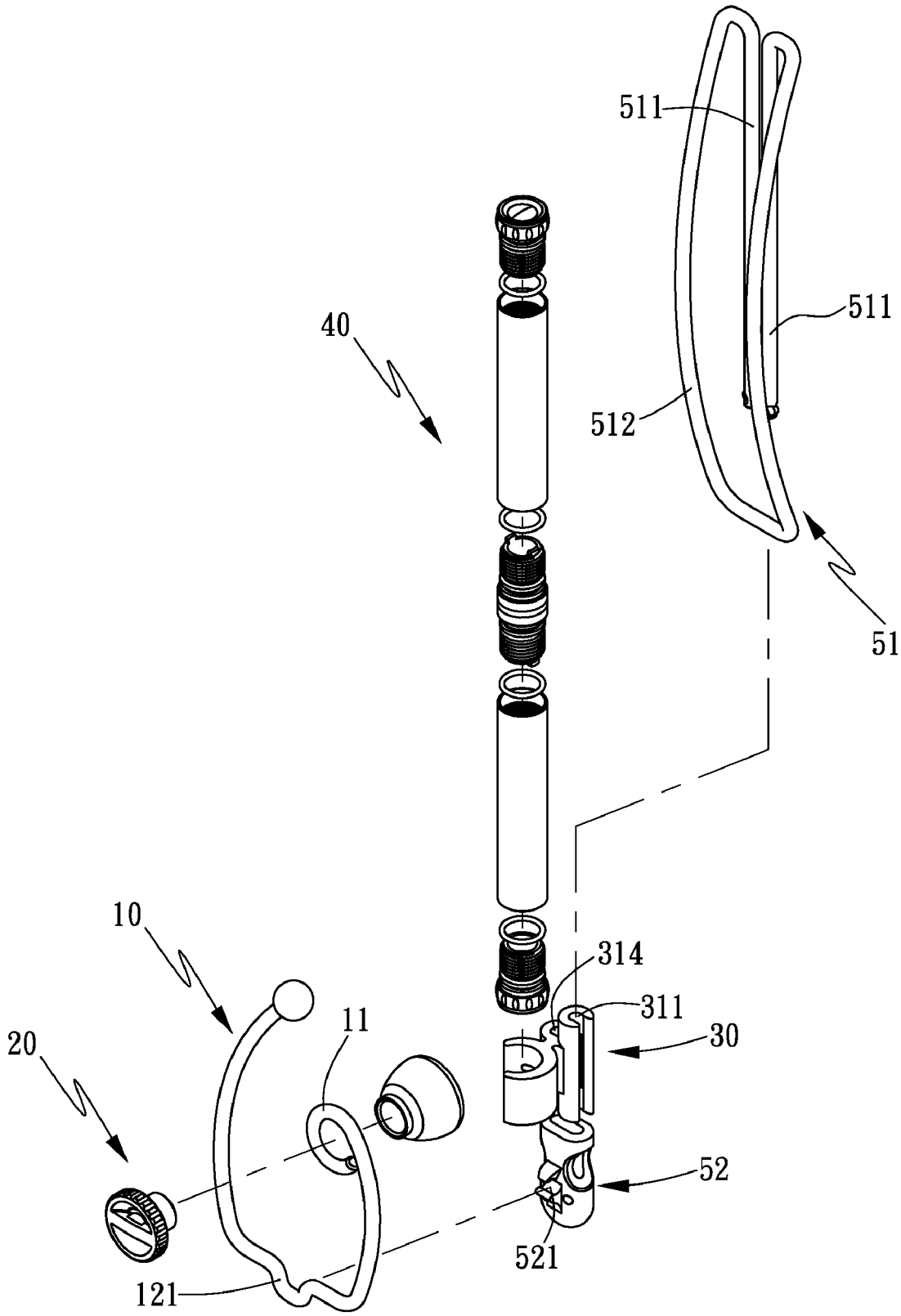
FIG. 6 is an exploded view of an ear hook device with illumination function in accordance with another embodiment of the present invention.
Figure 7:
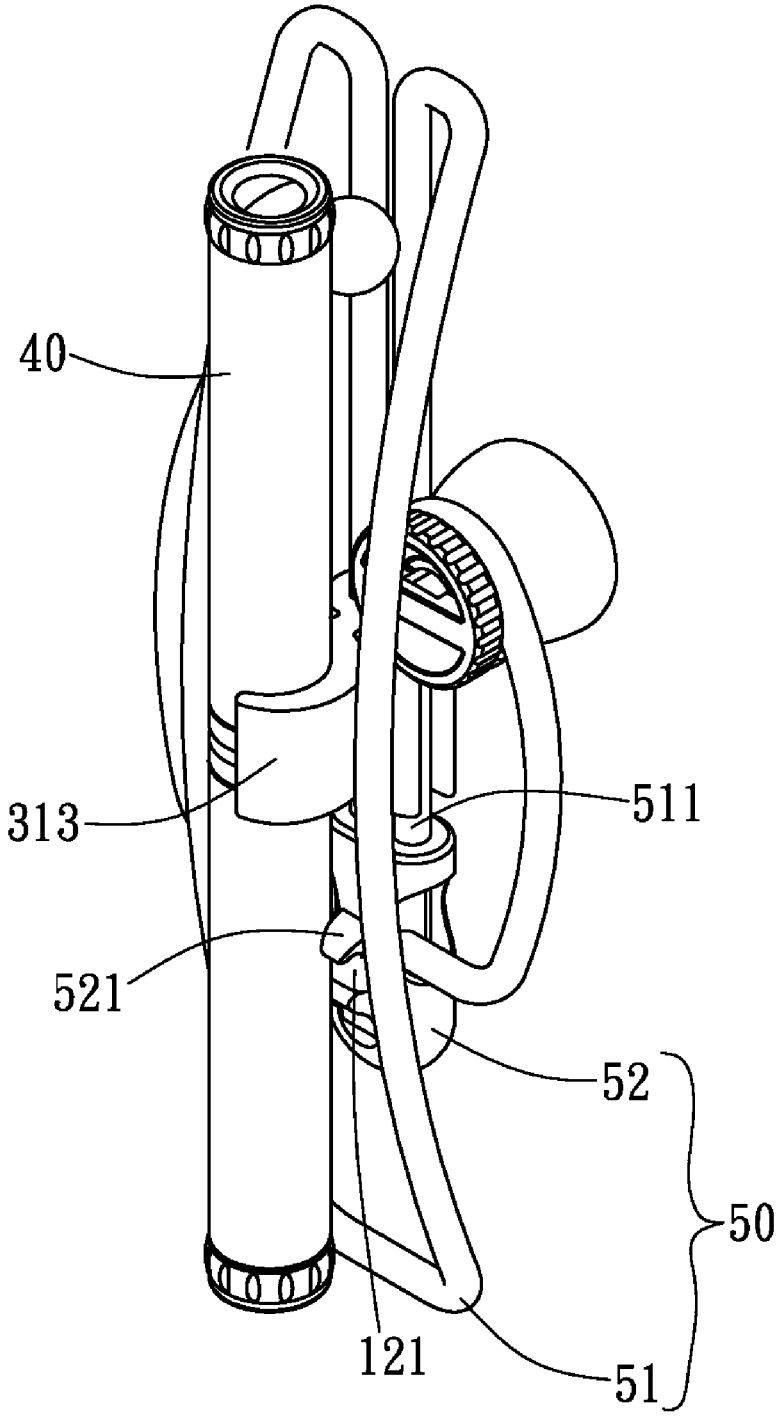
FIG. 7 is an assembly view of the ear hook device with illumination function in accordance with the another embodiment of the present invention.
Figure 8:
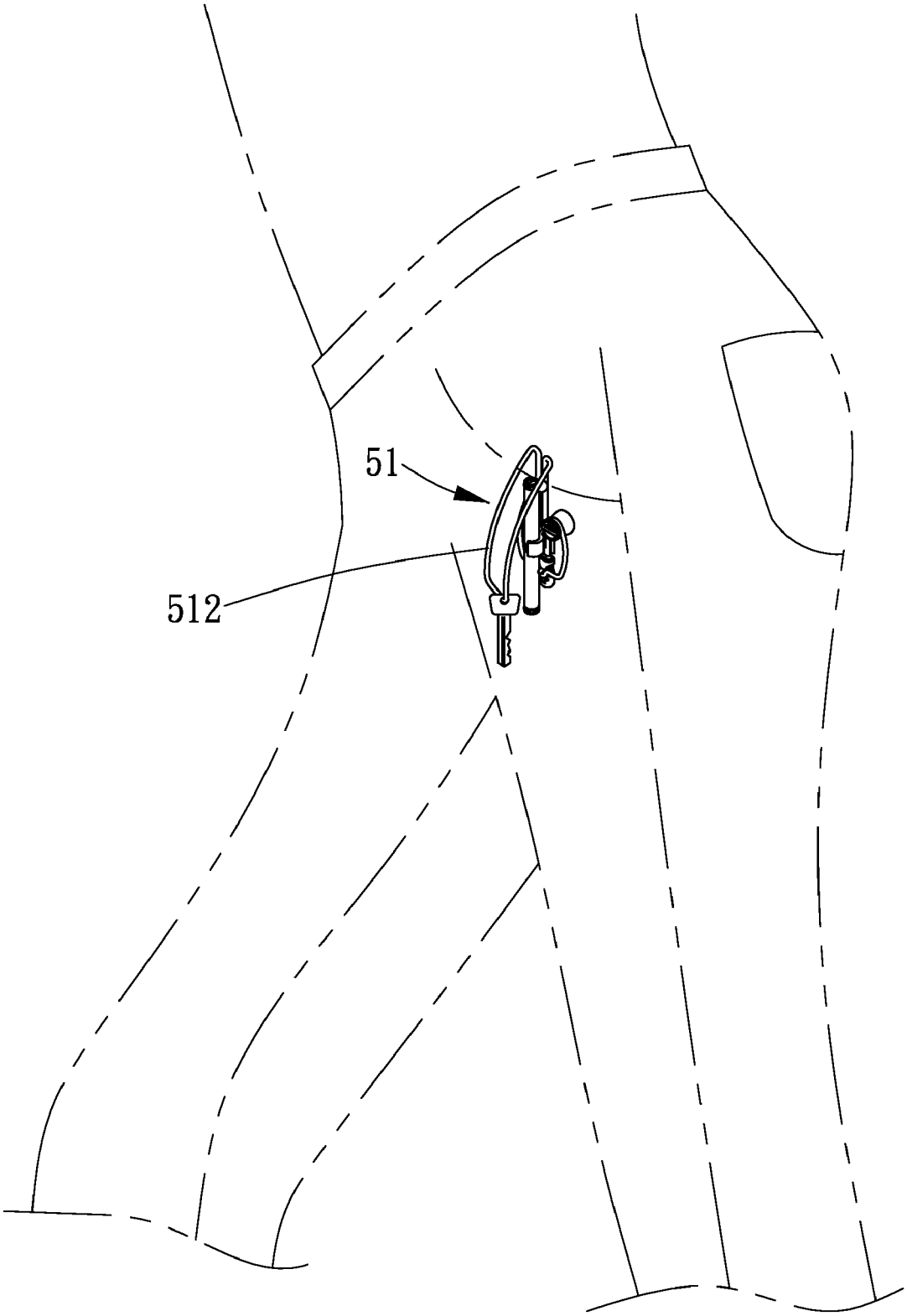
FIG. 8 shows that the ear hook device with illumination function in accordance with the another embodiment of the present invention is clipped to the pocket.

Referring then to FIGS. 6-8, an ear hook device with illumination function in accordance with another embodiment of the present invention can be provided with a holding assembly 50 which comprises a holding frame 51 and a seat 52. The holding frame 51 includes two inserting ends 511 which are connected to a holding portion 512 and inserted through the engaging portion 314 and the clamping portion 311 of the locking device 30 and into the seat 52. The seat 52 is provided with a hook portion 521 for engaging with the engaging portion 121 of the hook 10, and the carrying unit 40 is positioned in the mounting member 32 of the locking device 30, so that the ear hook device is held in the holding assembly 50. Furthermore, the holding frame 51 can be used to hold keys in such a manner that the keys are inserted onto the inserting ends 511 and restricted in the holding portion 512 of the holding frame 51, and after that, the inserting ends 511 are inserted in the seat 52 to prevent the keys from falling out from the inserting ends 511. In this way, the holding frame 51 can be used as a key ring.

When not in use, the ear hook device can be held in the holding assembly 50 and then put into a pocket or bag. For example, as shown in FIG. 8, the holding portion 512 of the holding assembly 50 can be clamped on the pocket or bag to fix the ear hook device, thus making it easier for the user to carry the ear hook device. Hence, aged people who go out alone can use the ear hook device of the present invention to carry keys, and when walking at night the ear hook device can provide illumination, and when arriving home the light emitting device carried by the carrying unit 40 can be used to light up the key hole. In addition, the ear hook device of the present invention can also be used by the outdoor enthusiasts, the ear hook device is held in the holding assembly 50 which can be clipped to the pocket of the user, and keys are retained on the holding frame 51, so that the keys won't bounce up and down within in the pocket, and the users don't have to worry that the keys are going to fall out of the pocket when they are in the middle of an action (such as walking, running, climbing, etc).

In addition to the abovementioned aspects of usability, the ear hook device with illumination function of the present invention also provides storage function. The holding assembly 50 can be used for storage of the ear hook device, making it easier for the user to carry the ear hook device.

While we have shown and described various embodiments in accordance with the present invention, it is clear to those skilled in the art that further embodiments may be made without departing from the scope of the present invention.

What is claimed is:

1. An ear hook device with illumination function, comprising:

a hook to be worn on the ear of a user;

a locking device including a retaining member and a mounting member, the retaining member being defined with a clamping portion with a notch, the clamping portion of the retaining member being clamped on the hook, the mounting member being connected to one side of the retaining member; and a carrying unit locked in the mounting member of the locking device;

wherein the mounting member is formed with a rib to be engaged with an annular groove formed in the carrying unit;

the carrying unit includes a connecting member and two cylinder assemblies, each of the cylinders includes a cylinder member and a cover, the two cylinder assembly each have one end connected to both ends of the connecting member, and then the two covers are mounted to the other end of the respective cylinder members.

2. The ear hook device with illumination function as claimed in claim 1, wherein the cylinder members are provided for storing batteries, and the covers are used to store light emitting devices, after being mounted to the cylinder members, the covers will be brought into electrical contact with the batteries stored therein, so that the light emitting devices are turned on and emit light.

3. The ear hook device with illumination function as claimed in claim 1, wherein the hook has a middle portion formed between both ends thereof and engaged in the clamping portion of the retaining member.

4. The ear hook device with illumination function as claimed in claim 3, wherein the retaining member is provided in a side opposite the clamping portion with a hole, an engaging piece is formed beside the hole, and an engaging portion is defined between the hole and the engaging piece, the middle portion protrudes upward to form an engaging portion which is inserted through the engaging portion of the retaining member and engaged in the engaging piece.

5. The ear hook device with illumination function as claimed in claim 1 further comprising an ear ornament which includes a seat portion and an ornament portion, the hook has one end curved to form a hole, the seat portion has one end inserted in the hole of the hook and the other end to press against the ear of the user, the ornament portion is inserted in the other end of the seat portion and exposed out of the hole of the hook.

6. An ear hook device with illumination function comprising:

a hook;

a locking device including a retaining member and a mounting member, the retaining member being defined on one side thereof with a clamping portion with a notch, the mounting member being connected to one side of the retaining member;

a carrying unit locked in the mounting member of the locking device; and a holding assembly including a holding frame and a seat, the holding frame including at least one inserting end which is connected to a holding portion and inserted through the clamping portion of the locking device and into the seat, the holding portion being arch-shaped and elastic, and the holding frame being a clip structure for allowing the holding frame to be clipped on an object in such a manner that the object is clipped between the holding portion and the inserting ends, and the seat being provided with a hook portion for engaging with the hook.

7. The ear hook device with illumination function as claimed in claim 6, wherein the mounting member is formed with a rib which is to be engaged with an annular groove formed in the carrying unit.

8. The ear hook device with illumination function as claimed in claim 6, wherein the carrying unit includes a connecting member and two cylinder assemblies, each of the cylinders includes a cylinder member and a cover, the two cylinder assembly each have one end connected to both ends of the connecting member, and then the two covers are mounted to the other end of the respective cylinder members.

9. The ear hook device with illumination function as claimed in claim 8, wherein the cylinder members are provided for storing batteries, and the covers are used to store light emitting devices, after being mounted to the cylinder members, the covers will be brought into electrical contact with the batteries stored therein, so that the light emitting devices are turned on and emit light.

10. The ear hook device with illumination function as claimed in claim 6, wherein the retaining member is provided with a hole, an engaging piece is formed beside the hole, and an engaging portion is defined between the hole and the engaging piece, the holding frame includes two inserting ends which are inserted in the engaging portion and the clamping portion of the locking device.

11. The ear hook device with illumination function as claimed in claim 6 further comprising an ear ornament which includes a seat portion and an ornament portion, the hook has one end curved to form a hole, the seat portion has one end inserted in the hole of the hook and the other end to press against the ear of the user, the ornament portion is inserted in the other end of the seat portion and exposed out of the hole of the hook.

* * * * *